United States Patent [19]

Stein et al.

[11] Patent Number: 4,662,523

[45] Date of Patent: May 5, 1987

[54] ADJUSTABLE REFRIGERATION DISPLAY RACK

[75] Inventors: Norman R. Stein, Minneapolis; Carl H. Rahn, White Bear Lake, both of Minn.

[73] Assignee: Stein Industries Inc., Minneapolis, Minn.

[21] Appl. No.: 723,204

[22] Filed: Apr. 15, 1985

[51] Int. Cl.[4] ..... A47F 7/00

[52] U.S. Cl. ..... 211/59.2; 211/153

[58] Field of Search ..... 211/59.2, 149, 150, 211/153, 147, 148; 312/116 X, 128; 240/448, 455, 456, 460, 423, 396

[56] References Cited

U.S. PATENT DOCUMENTS

| | | | |
|---|---|---|---|
| 733,100 | 7/1903 | Werner | 248/456 |
| 1,564,594 | 12/1925 | Leh | 248/448 |
| 1,793,036 | 2/1931 | Whitney | 211/150 X |
| 3,176,947 | 4/1965 | Invesso | 248/448 X |
| 3,249,392 | 5/1966 | Berman | 312/128 X |
| 3,381,928 | 5/1968 | White | 248/455 |
| 3,586,411 | 6/1971 | Brigham | 312/128 X |
| 4,084,703 | 4/1978 | Hosalla . | |
| 4,421,943 | 12/1983 | Withjack | 248/455 X |

*Primary Examiner*—Robert W. Gibson, Jr.
*Assistant Examiner*—Sarah A. Lechok Eley
*Attorney, Agent, or Firm*—Kinney & Lange

[57] ABSTRACT

The present invention is an adjustable refrigeration display rack arranged to support produce on a refrigerated produce case for display. The adjustable display rack includes a telescopic frame carrying a support rack and anchors for securing the frame to the refrigerated produce case. The display rack further includes a multi-section shelf unit comprising a plurality of shelf sections connected in end to end relation. One of the shelf sections is slidably mounted on the frame. The other shelf sections are supported above the frame by legs pivotally carried by the shelf sections. The support legs have a free end arranged to releasably engage selected teeth of the support rack to support the shelf sections on the frame in a selected angular orientation.

28 Claims, 10 Drawing Figures

ADJUSTABLE REFRIGERATION DISPLAY RACK

BACKGROUND OF THE INVENTION

1. Field of the Invention

This invention relates generally to an adjustable display rack, and particularly to an adjustable refrigeration rack for supporting produce on refrigerated produce cases for display.

2. Description of the Prior Art

It is known in the art to use shelving systems or racks to support perishable goods on refrigerated produce cases for display. The manner in which produce is supported by these systems provides increased sanitation and further creates the appearance of massive bulk. However, these prior art systems have fixed structures, preventing realignment of the system to create a different display appearance, or to accommodate perishable goods of different sizes and shapes.

U.S. Pat. No. 4,084,703 to Hossalla and Stein describes an improved display rack which includes a first shelf section telescopically slidably mounted within a second shelf section so that the rack can be mounted within different size refrigerated produce cases. The Hossalla and Stein refrigeration display rack shelf provides an inclined support surface and a substantially horizontally oriented support surface on which produce can be stacked.

While the Hossalla and Stein refrigeration display rack provides greater adjustability than the fixed structures of the prior art, there is a need for an adjustable display rack capable of supporting produce of different sizes and shapes in a variety of display configurations.

SUMMARY OF THE INVENTION

The present invention is an adjustable refrigeration display rack capable of supporting produce of different sizes and shapes in a variety of display configurations. The adjustable display rack has two major components, an adjustable frame and a multi-section adjustable shelf unit supported above the frame.

In a first preferred embodiment of the present invention, the adjustable refrigeration display rack includes a telescopic frame for supporting the shelf unit between oppositely disposed walls of a refrigerated produce case. The shelf unit includes a plurality of shelf members connected in end to end relation, including a first shelf member slidably mounted on the frame. The shelf unit further carries means for supporting the shelf unit above the frame in a selected angular orientation.

In a second preferred embodiment of the adjustable display rack, the shelf unit comprises an articulated shelf member having a plurality of shelf sections pivotally connected in end to end relation, including a first shelf section connected to the frame. Supports are carried by the articulated shelf member for supporting the shelf sections above the frame in a plurality of selectable angular orientations.

In a third preferred embodiment of the adjustable display rack of the present invention, the multi-section adjustable shelf unit includes a first shelf connected to the frame and telescopically received within a second shelf. A support is carried by the second shelf for supporting the shelf unit above the frame in a selected angular orienation.

DETAILED DESCRIPTION OF THE PREFERRED EMBODIMENTS

Figure 1:
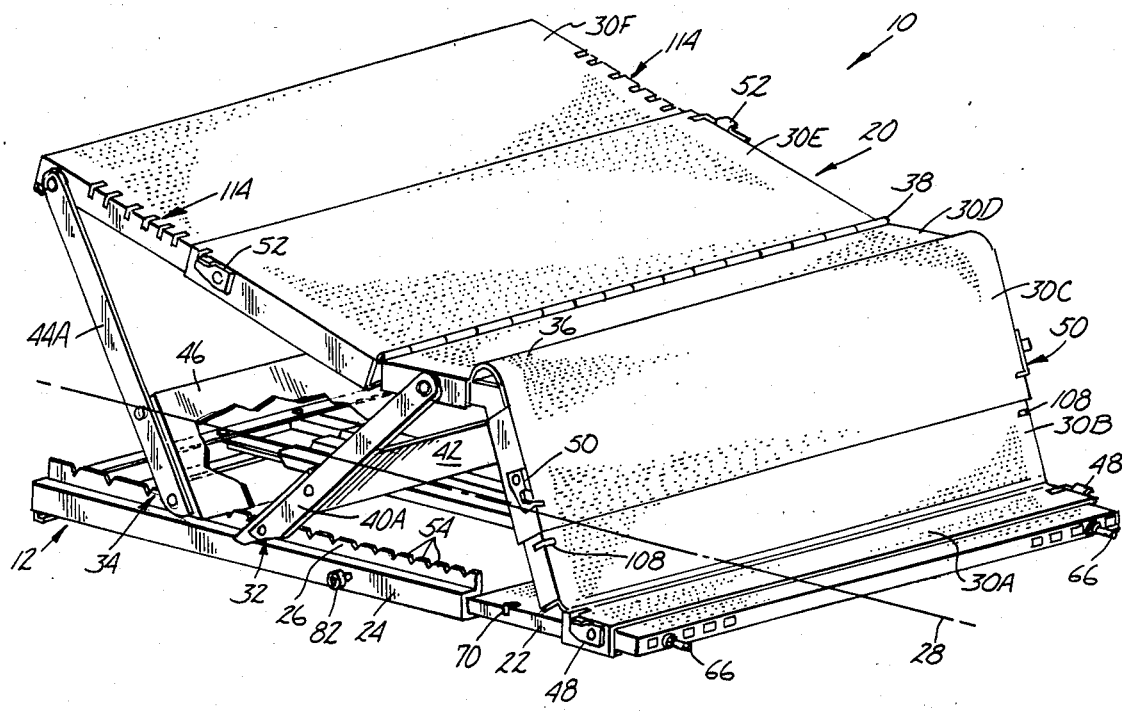
FIG. 1 (sheet 1) is a perspective view of an adjustable refrigeration display rack of the present invention with a portion removed, illustrating an adjustable multi-section shelf unit supported above a telescopic frame.
Figure 2A:
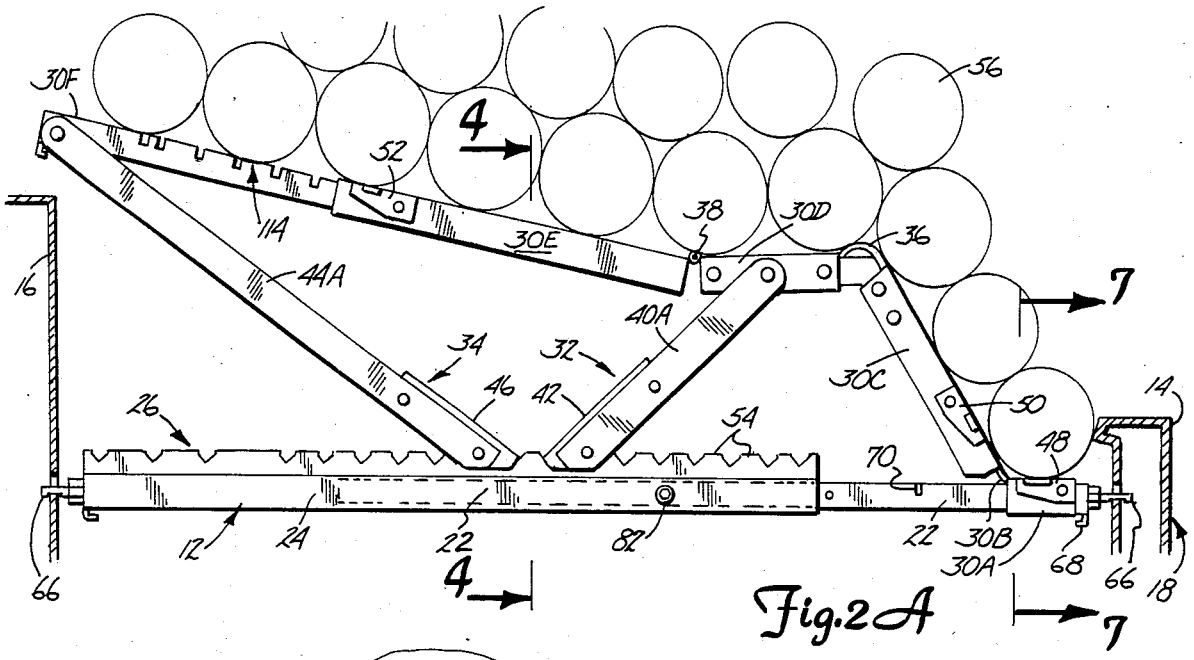
FIG. 2A (sheet 2) is a side elevational view of the adjustable refrigeration display rack of the present invention secured to and supported between a front and a rear wall of a refrigerated produce case, the multi-section shelf unit being supported above the telescopic frame in a first angular orientation supporting grapefruit for display.
Figure 2B:
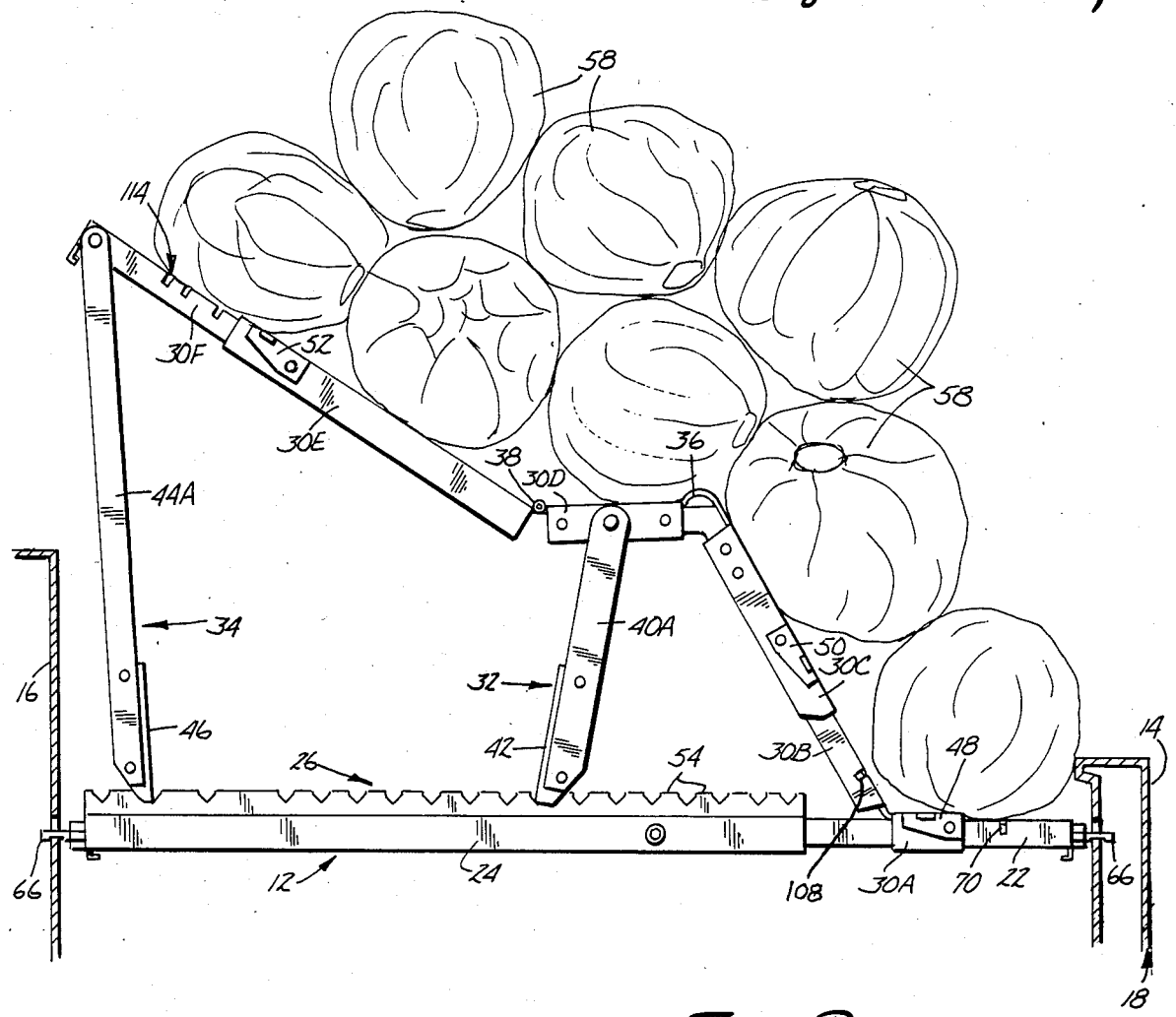
FIG. 2B (sheet 2) is a view similar to FIG. 2A, illustrating the multi-section shelf unit supported above the telescopic frame in a second angular orientation, supporting a different size and shape produce.

As shown in the perspective view of FIG. 1, an adjustable refrigeration display rack 10 of the present invention has two major parts, a telescoping frame 12 (which is arranged to be supported between a front wall 14 and a rear wall 16 of a refrigerated produce case 18, as shown in FIGS. 2A and 2B), and an adjustable, multi-section shelf unit 20 which is supported by and above the frame 12.

The telescoping frame 12 includes an inner frame 22, an outer frame 24 and a support rack 26. The inner frame 22 is telescopically slidably mounted on the outer frame 24 for adjustment along a longitudinal axis 28. The shelf unit 20 includes six panel sections 30A through 30F, and a pair of leg units 32 and 34. A first panel section 30A is slidably supported on the inner frame 22. An inclined second panel section 30B is connected to a rear end of the first panel section 30A and is telescopically received within an inclined third panel section 30C. At its upper end, the inclined third panel section 30C is connected to a front edge of a fourth, generally horizontal panel section 30D. The third panel section 30C further defines a ridge 36, extending substantially vertically upward from the horizontal fourth panel section 30D. A fifth panel section 30E is pivotally connected to a rear edge of the fourth panel section 30D by a hinge 38, and a sixth panel section 30F is telescopically received within the fifth panel section 30E.

The leg unit 32, which includes a pair of legs 40A and 40B, and a cross brace 42, is pivotally connected at an upper end to the fourth panel section 30D, and at a lower end engages the rack 26. Similarly, the rearward leg unit 34, which includes a pair of legs 44A and 44B, and a cross brace 46, is pivotally connected to a rear end of the sixth panel section 30F at an upper end, and engages the rack 26 at a lower end.

The relative angular position of the shelf panel sections 30A through 30F with respect to each other and the frame 12, may be adjusted in a number of ways, to change the configuration of the display rack 20. First, the first panel section 30A may be positioned at various points along the inner frame 22, and secured in place by a first set of catch members 48 carried by the first panel section 30A. Secondly, the telescopic relation of the second shelf panel section 30B and the third shelf panel section 30C, and the fifth shelf panel section 30E and the sixth panel section 30F, permits adjustment of their length to change the configuration of the shelf unit 20. A second set of catch members 50 fix the position of the second shelf panel section 30B and the third shelf panel section 30C with respect to each other. Similarly, a third set of catch members 52 carried by the fifth shelf panel section 30E, fixes the position of the fifth shelf panel section 30E and the sixth shelf panel section 30F with respect to each other. Thirdly, the leg units 32 and 34 may be adjusted to engage various teeth 54 of the support rack 26, to change the relative angular orientation of the shelf panel sections with respect to each other and the frame 12.

FIGS. 2A and 2B illustrate how the adjustable refrigeration display rack 10 of the present invention can be used to support produce of different size and shape in different configurations. In FIG. 2A, the display rack 10 is supporting grapefruit 56. In FIG. 2B, the position of the first shelf panel section 30A with respect to the inner frame 22, the position of the second shelf panel section 30B with respect to the third shelf panel section 30C, the position of the fifth shelf panel section 30E with respect to the sixth shelf panel section 30F, and the position of the forward leg unit 32 and the rearward leg unit 34, have all been adjusted to support produce (cabbage 58) of a different size and shape, in a different orientation on the telescoping frame 12.

Figure 3:
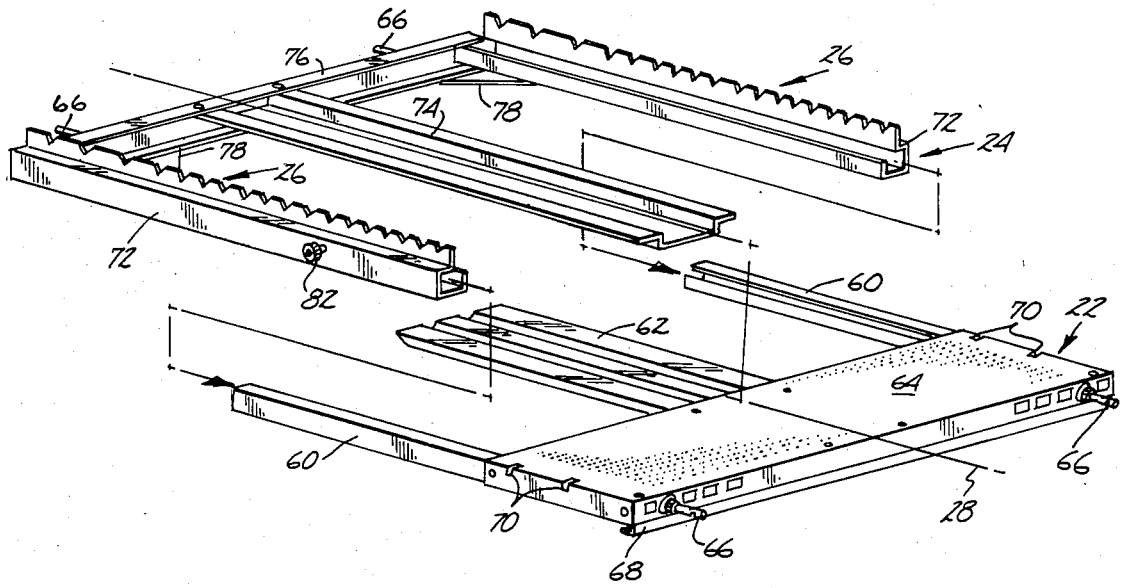
FIG. 3 (sheet 1) is an exploded view of the telescopic frame of the present invention, illustrating an inner frame slidably telescopically received by an outer frame.

As shown in FIG. 3, the inner panel 22 includes a pair of U-shaped side rails 60 and a central guide 62, connected together at one end by a front perforated panel 64. Projecting outward from a leading edge of the front perforated panel 64, are a pair of anchors or hooks 66 for securing the inner frame 22 to the front wall 14 of the produce case 18, as illustrated in FIGS. 2A and 2B. Extending downward from the leading edge of the front perforated panel 64, is a support flange 68. A first series of spaced notches 70 are defined adjacent upper lateral edges of the front perforated panel 64 through which portions of the catch members 48 releasably extend to fix the position of the first shelf panel section 30A on the inner frame 22.

The outer frame 24 includes a second pair of U-shaped side rails 72, larger than the side flanges 60 of the inner panel 22, which include a pair of parallel upstanding flanges which define the support rack 26. The outer frame 24 further includes a slide 74 and an end flange 76. The second pair of U-shaped side rails 72 and the slide 74 are secured to the rear end flange 76 by bolts or other suitable means. Corner braces 78 are secured between the side rails 72 and the end flange 76 to further strengthen the outer frame 24. A second set of outwardly extending anchors (or hooks) 66 are carried by the rear end flange 76, arranged to extend through notches defined in the rear wall 16 of the produce case 18, to support the outer frame 24 thereon. The outer frame 24 further includes a pair of set screws 82, carried by the side flanges 72.

Figure 4:
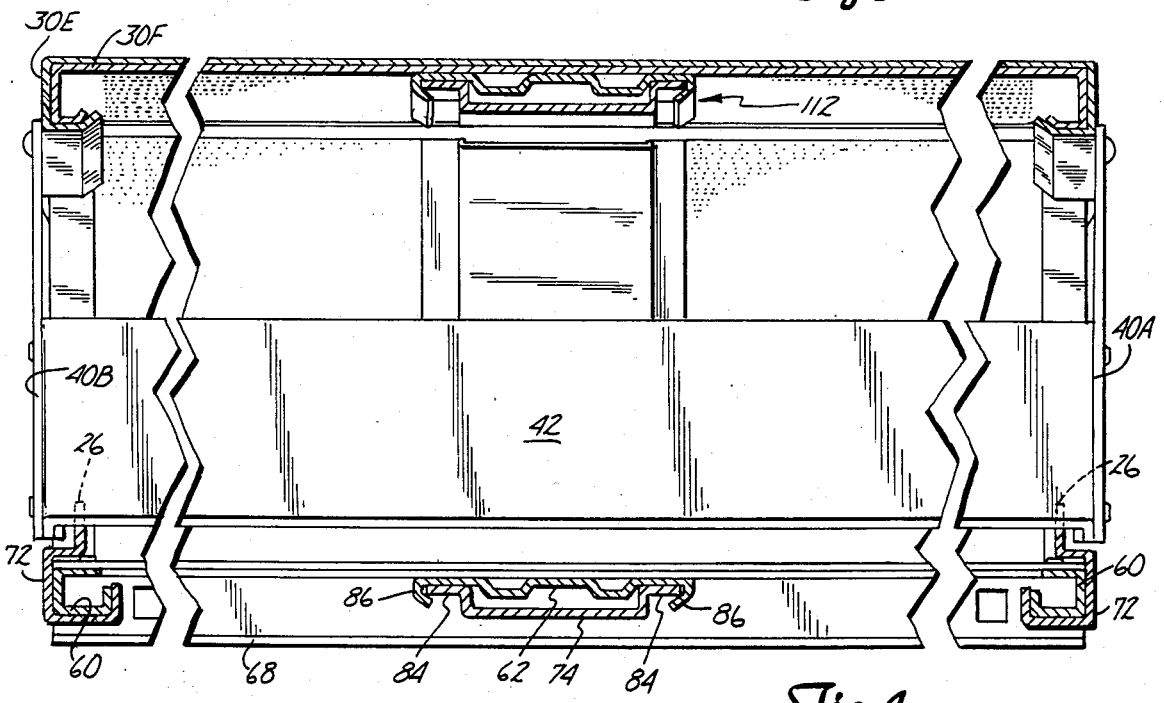
FIG. 4 (sheet 3) is a cross sectional view of the adjustable refrigeration display rack of the present invention taken along the line 4—4 of FIG. 2A.

The inner frame 22 is telescopically slidably supported on the outer frame 24 at its center and at its lateral edges. The side rails 60 of the inner frame 22 are slidably mounted in the side rails 72 of the outer frame 24. The slide 74 of the outer frame 24 mates with and is slidably mounted in the guide 62 of the inner frame 22, as indicated in FIG. 4. The slide 74 includes oppositely extending flanges 84, which extend toward the side rails 60 of the inner frame 22. The outward extending flanges 84 are supported by inward projecting lips 86 of the guide 62 as shown.

As shown in FIGS. 2A and 2B, the anchors 66 extend through openings in the front wall 14 and the rear wall 16 of the produce case 18 to support the frame 12 on and between these walls. Once properly mounted, the set screws 82 are tightened to fix the position of the inner frame 22 with respect to the outer frame 24. This method of anchoring the frame 12 to the produce case 18 is for illustration purposes only, and may be modified or substituted as needed. The telescopic nature of the frame 12 permits adjustment of the length of the frame 12 to accommodate produce cases of different front-to-rear dimension.

Mounted on and above the frame 12 is the multi-section shelf unit 20. All of the shelf panel sections 30A through 30F are perforated, as indicated at 88 in FIG. 5, to facilitate the passing of air through the openings and the shelf panel sections to cool the produce supported by the adjustable refrigeration display rack 10.

Figure 5:
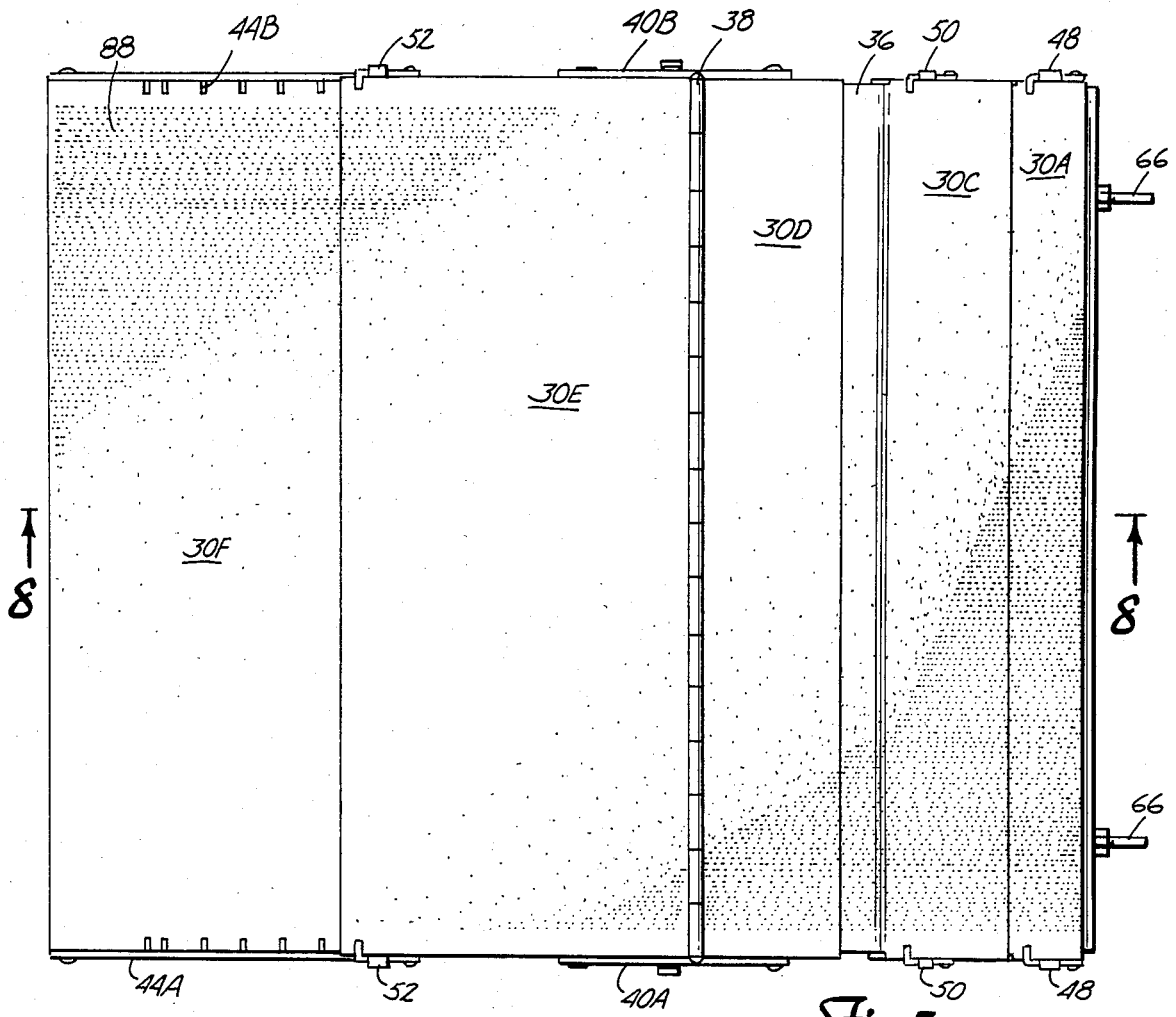
FIG. 5 (sheet 3) is a top plan view of the adjustable refrigeration display rack of the present invention when oriented as in FIG. 2A.
Figure 7:
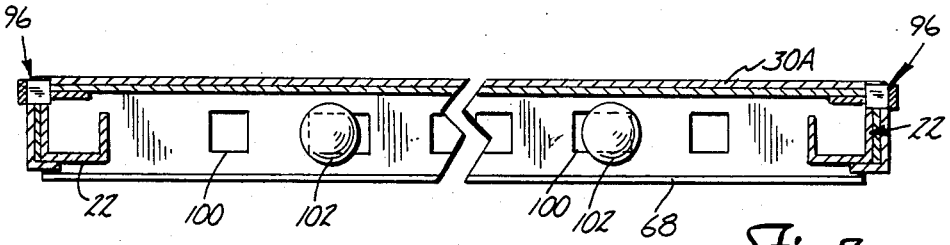
FIG. 7 (sheet 4) is a cross sectional view of the adjustable refrigeration display rack of the present invention taken along the line 7—7 in FIG. 2A.
Figure 6:
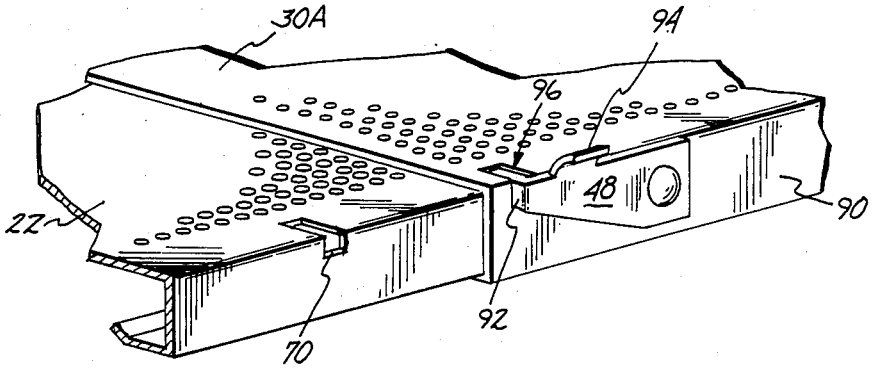
FIG. 6 (sheet 4) is a partial perspective view of a portion of a first shelf slidably mounted on a portion of the frame of the present invention, illustrating a catch member pivotally mounted on the first shelf engaging the frame to fix the position of the shelf and frame with respect to each other.
Figure 8:
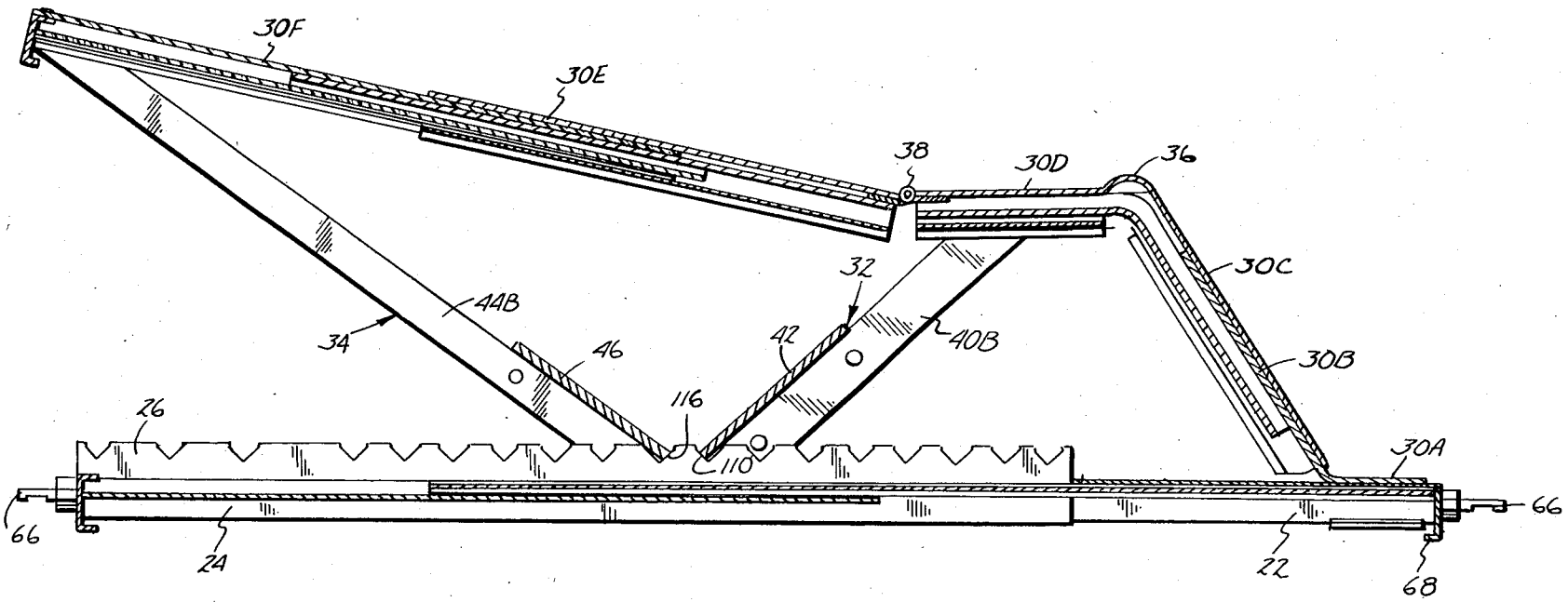
FIG. 8 (sheet 5) is a longitudinal cross sectional view of the adjustable refrigeration display rack of the present invention, taken along the line 8—8 in FIG. 5.

As shown in FIGS. 5, 6 and 7, the first generally horizontal first panel section 30A is slidably mounted on the inner frame 22 for longitudinal movement over the inner frame 22. The first set of catch members 48 are pivotally mounted on lateral edges 90 of the first panel 30A. The catch members 48 include an engaging flange 92 extending inward toward the center of the first panel section 30A, and tabs 94 extending outward from the lateral edges 90 of the first panel 30A. The first panel 30A further includes an opening 96 through which the engaging flange 92 is rotated to engage one of the series of selectively positioned, spaced apart notches 70 defined along the upper lateral edges of the inner frame 22. Rotation of the engaging flange 92 into engagement with one of the notches 70 defined by the inner frame 22, releasably fixes the position of the first shelf panel section 30A with respect to the inner frame 22. The tabs 94 provide a grip or handle for rotation of the catch members 48.

As also shown in FIG. 7, the flange 68 which defines the front or leading end of the inner panel 22, is arranged with a plurality of openings 100. The anchors 66 are secured to the support flange 68, through selected openings 100, by carriage bolts 102. The plurality of openings 100 provides flexibility in positioning the anchors 66.

The second shelf panel section 30B and the third shelf panel 30C are arranged with a guide/slide 106 (see FIG.

9), similar to the guide/slide arrangement of the inner frame 22 and the outer frame 24. Thus, the second shelf panel section 30B is slidably supported on the third shelf panel section 30C at its center and its sides. Each edge of the second shelf panel section 30B further includes a series of selectively positioned, spaced apart notches 108 (see FIG. 1). Engaging flanges of the catch members 50, which are carried by the opposite edges of the third inclined shelf panel section 30C, extend into the notches 108 to releasably fix the position of the second shelf panel section 30B and the third shelf panel section 30C with respect to each other.

Pivotally secured to lateral edges of the fourth shelf panel section 30D is the forward leg unit 32, and specifically the legs 40A and 40B of the forward leg unit 32. The cross brace (or plate) 42 carried by the support legs 40A and 40B of the forward leg unit 32, define an engaging edge 110 for engaging selected teeth 54 of the support rack 26 carried by the frame 12. The forward leg unit 32 supports the shelf panel sections 30A through 30D (which together form a "first shelf"), in a selected angular orientation. Adjustment of the position of the forward leg unit 32 makes it possible to telescopically extend shelf panel sections 30B and 30C and still maintain the fourth shelf panel section 30D in a substantially horizontal orientation.

Figure 9:
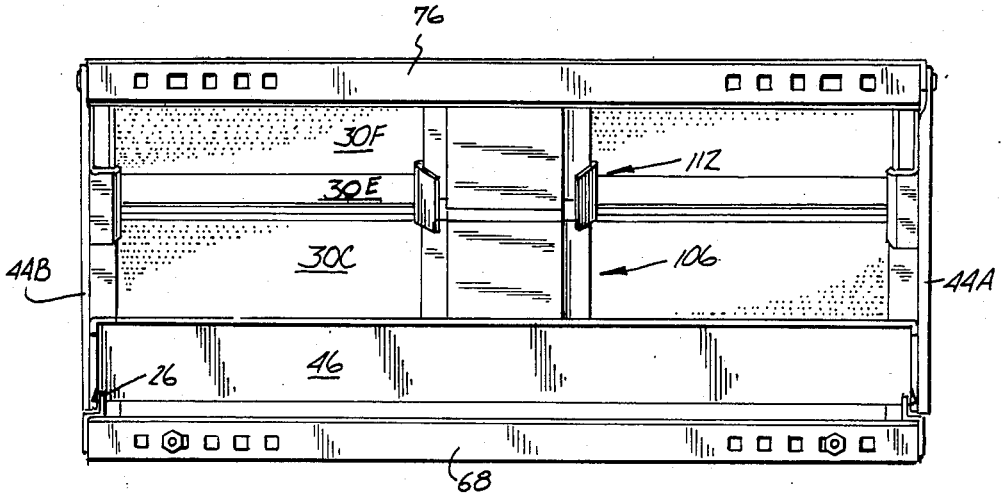
FIG. 9 (sheet 4) is a rear elevation of the adjustable refrigeration display rack of the present invention, when oriented as in FIG. 2A.

The fifth shelf panel section 30E and the sixth shelf panel section 30F are arranged with a third slide/guide arrangement 112 as indicated in FIGS. 4 and 9. Thus, the sixth shelf panel section 30F is slidably mounted on the fifth shelf panel section 30E along its center and at its sides. The sixth shelf panel section 30F further includes a third series of selectively positioned, spaced apart notches 114 along each edge, into which engaging flanges of the third pair of catch members 52 extend to releasably fix the position of the sixth shelf panel section 30F with respect to the fifth shelf panel section 30E.

The rearward leg unit 34, and specifically a first end of the legs 44A and 44E, are pivotally mounted on the sixth shelf panel section 30F. The cross plate 46, which connects the legs 44A and 44B at a second end, defines a second engaging edge 116 for engaging a selected tooth 54 of the support rack 26 to support the fifth shelf panel section 30E and the sixth shelf panel setion 30F (defining a "second shelf") in a selected angular orientation with respect to the first shelf on the frame 12.

In one sense, the first shelf (shelf panel sections 30A through 30D) and the second shelf (shelf panel sections 30E and 30F) together comprise one articulated shelf, with the first shelf being connected to the frame 12. Both the first and second shelves are supported on the frame 12 in a selected angular orientation by the forward leg unit 32 and the rearward leg unit 34.

In another sense, the adjustable multi-section shelf unit 20 includes a plurality of shelves (shelf panel sections 30A through 30D) connected in end-to-end relation. At least two shelves are pivotally connected to each other and at least one shelf is connected to (or slidably mounted on) the frame 12. Thus, the multi-section shelf unit 20 in FIG. 1 could just as easily describe a first shelf 30A slidably mounted on the frame 12, and connected to a second, inclined telescopic shelf (second shelf panel 30B and third shelf panel 30C), which second shelf is rigidly connected to a third shelf 30D, and which third shelf 30D is in turn pivotally connected to a fourth telescopic shelf (fifth shelf panel 30E and the sixth shelf panel section 30F).

In yet another sense, the shelf panel sections 30A and 30B define a first shelf connected at one end to the frame and slidably received at a second end within a second shelf with adjoining angularly disposed surfaces (shelf panel sections 30C and 30D).

Other combinations of shelves and manners of connecting the shelves are contemplated by the present invention, the combinations recited not being intended to be limiting.

Although the present invention has been described with reference to preferred embodiments, workers skilled in the art will recognize that changes may be made in form and detail without departing from the spirit and scope of the invention.

What is claimed is:

1. An adjustable refrigeration display rack for supporting produce in a refrigerated produce case of the type having a pair of spaced walls, comprising:

adjustable frame means for positioning the rack between the spaced walls of the refrigerated produce case;

multi-section shelf means connected at a first end to the frame means and carrying means for adjustably supporting the shelf means on the frame means in a selected angular orientation;

wherein the multi-section shelf means includes a first shelf panel section connected to the frame, an inclined, second shelf panel section fixed to a rear end of the first shelf panel section, a third generally horizontally oriented shelf panel section fixed to a rear end of the second shelf panel section, and a fourth panel section pivotally connected to a rear edge of the third panel section; and wherein the means for supporting includes a leg unit for supporting the fourth panel section above the frame means at a selected variable angle with respect to the third panel section.

2. The adjustable display rack of claim 1 wherein the adjustable frame means includes an inner frame telescopically slidably mounted within an outer frame, and the first shelf panel section is slidably mounted on the inner frame.

3. The adjustable display rack of claim 1 wherein the shelf panel sections are perforated to facilitate the passage of air therethrough.

4. The adjustable display rack of claim 1 and further comprising means for securing the frame means to and between the spaced walls of the refrigerated produce case.

5. The adjustable display rack of claim 1 wherein:

the frame means further includes a support rack having a plurality of selectively spaced teeth; and the leg unit is arranged to releasably engage a selected tooth of the support rack to support the shelf sections in a selected angular orientation on the frame means.

6. The adjustable display rack of claim 1 wherein a ridge is defined at the junction of the second and third shelf panel sections, for holding goods on the third shelf panel section.

7. The adjustable display rack of claim 1 wherein the multi-section shelf means comprises an articulated shelf having a plurality of shelf sections pivotally connected in end to end relation, including a first shelf section connected to the frame means.

8. An adjustable refrigeration display rack for supporting produce in a refrigerated produce case of the type having a pair of spaced walls, comprising:

adjustable frame means for positioning the rack between the spaced walls of the refrigerated case; and multi-section shelf means connected at a first end to the frame means and carrying means for adjustably supporting the shelf means on the frame means in a selected angular orientation;

wherein the multi-section shelf means includes a first shelf connected to the frame means, and telescopically received within a second shelf, the second shelf carrying the means for supporting the multi-section shelf means on the frame means in a selected angular orientation.

9. An adjustable refrigeration display rack for supporting produce on a refrigerated produce case of the type having spaced walls, comprising:

telescopic frame means including means for securing the frame means to a wall of the refrigerated produce case;

articulated multi-section shelf means including a plurality of shelf sections including a first shelf section connected to the frame means and a second telescoping shelf section pivotally connected to a rearward end of the first shelf section;

means for supporting the shelf sections above the frame means in a selected angular orientation; and wherein the frame means further includes a support rack having a plurality of selectively spaced teeth, and the means for supporting includes leg units pivotally mounted on the second shelf section for engaging selected teeth of the support rack to support the second shelf section above the frame means in a selected angular orientation with respect to the first shelf section.

10. The adjustable display rack of claim 9 wherein the frame means further includes a support rack having a plurality of selectively spaced teeth, and the means for supporting includes leg units pivotally mounted on selected shelf sections for engaging selected teeth of the support rack to support the shelf sections on the frame means in a selected angular orientation with respect to each other.

11. The adjustable display rack of claim 10 wherein at least one of the shelf sections is telescopically extensible in a direction substantially perpendicular to the joined ends of the shelf sections.

12. The adjustable display rack of claim 9 wherein the first shelf section is slidably mounted on the frame means, and further comprising means for releasably fixing the first shelf section at selected positions along the frame means.

13. An adjustable refrigeration display rack for supporting produce on a refrigerated produce case of the type having spaced walls, comprising:

telescopic frame means carrying means for securing the frame means to and between the spaced side walls of the refrigerated produce case;

first telescopic shelf means including an inner shelf section telescopically slidably mounted within an outer shelf section, the inner shelf section being connected to the frame means;

support means carried by the outer shelf section for supporting the shelf means above the frame means in a selected angular orientation; and second telescopic shelf means pivotally connected to the outer shelf section of the first telescopic shelf means, and carrying second means for supporting the second shelf means on the frame means in a selected angular orientation with respect to the first shelf means.

14. A display shelf for exhibiting produce of different shapes and sizes in a refrigeration case comprising:

(a) a frame constructed and arranged to fit within refrigeration case; and (b) adjustable means connected to the frame for supporting produce above the frame in a variety of different relative angular configurations, the adjustable means including:

(1) an articulated shelf assembly which includes a first shelf section connected to the frame, and a second shelf section hinged to the rear end of the first shelf section;

(2) a pair of leg members, each pivotally connected to the second shelf section for supporting the second shelf section above the frame at a selected angular position with respect to the first shelf section;

(3) wherein the first shelf section includes a generally horizontal lower portion, an inclined middle portion, a generally horizontal top portion, and a ridge between the middle and top portions for retaining produce on the top portion; and (4) wherein the second shelf section includes an outer shelf hinged at its forward end to the horizontal top portion, and an inner shelf telescopically slidably mounted within the outer shelf.

15. A display shelf as recited in claim 14 and further comprising means for mounting the display shelf on the refrigeration case.

16. The display shelf as recited in claim 14 and further comprising means mounted on the outer shelf for releasably fixing the inner shelf at a desired position.

17. An adjustable refrigeration display rack for supporting produce in a refrigerated produce case of the type having a pair of spaced walls, comprising:

adjustable frame means connectable to a wall of the refrigerated produce case;

multi-section shelf means connected to a first end of the frame means;

means, connected to the shelf means, for adjustably supporting the shelf means above the frame means in a selected angular orientation;

wherein the plurality of shelf panel sections includes a first shelf panel section connected to the frame, an inclined second shelf panel section fixed to a rear end of the first shelf panel section, and a third generally horizontally oriented shelf panel section fixed to a rear end of the second shelf panel section, and a fourth panel section pivotally connected to the third panel section; and wherein the means for supporting includes a pivotal leg unit for supporting the fourth panel section above the frame means at a selected, variable angle with respect to the third shelf panel section.

18. The adjustable display rack of claim 17 wherein a first shelf panel section is slidably mounted on the frame means.

19. The adjustable display rack of claim 18 and further comprising means for releasably fixing the first shelf panel section at selected positions along the frame means.

20. The adjustable display rack of claim 17 wherein the adjustable frame means includes an inner frame telescopically slidably mounted within an outer frame.

21. The adjustable display rack of claim 17 wherein the shelf panel sections are perforated to facilitate the passage of air therethrough.

22. The adjustable display rack of claim 17 and further comprising means for securing the frame means to the refrigerated produce case.

23. The adjustable display rack of claim 17 wherein:

the frame means further includes a support rack having a plurality of selectively spaced teeth; and the means for supporting includes at least one leg unit pivotally carried by the multi-section shelf means arranged to releasably engage a selected tooth of the support rack to support the shelf sections in a selected angular orientation on the frame means.

24. The adjustable display rack of claim 17 wherein a ridge is defined at the junction of the second and third shelf panel sections, for holding goods on the third shelf panel section.

25. The adjustable display rack of claim 17 and further comprising a fifth panel section telescopically slidably mounted within the fourth shelf section.

26. A display shelf for exhibiting produce at different shapes and sizes in a refrigeration case comprising:

a frame constructed and arranged to fit within the refrigeration case;

an articulated shelf assembly connected to the frame for supporting produce above the frame in a variety of different relative angular configurations, the articulated shelf assembly including:

a first shelf section connected to the frame which includes a generally horizontal lower portion, an inclined middle portion, a generally horizontal top portion, and a ridge between the middle and top portions for retaining produce on the top portion; and a second shelf section which includes an inner shelf telescopically slidably mounted within an outer shelf, the second shelf section being hinged to a rear end of the generally horizontal top portion of the first shelf section; and a plurality of leg members pivotally connected to the second shelf section for supporting the second shelf section above the frame at a selected angular position with respect to the generally horizontal top portion of the first shelf section.

27. An adjustable refrigeration display rack for supporting produce in a refrigerated produce case of the type having a pair of spaced walls, comprising:

adjustable frame means for connection to a wall of the refrigerated produce case;

a multi-section shelf which includes a first shelf panel section connected to a first end of the frame means and a second shelf panel section hinged to a rear end of the first shelf panel section; the second shelf panel section including an inner shelf telescopically slidably mounted within an outer shelf; and leg means pivotally connected to the second shelf panel section for supporting the second shelf panel section above the frame means at a selected angular orientation with respect to the first shelf panel section, the leg means having a lower end which engages the frame means at selected positions along the frame to provide different angular orientations of the second shelf panel section.

28. An adjustable refrigeration display rack for supporting produce in a refrigerated produce case comprising:

a telescopically adjustable frame constructed and arranged to fit within the refrigeration case;

a generally horizontal first shelf portion;

an inclined second shelf portion extending rearwardly and upwardly from a rear edge of the generally horizontal first shelf portion;

a generally horizontal third shelf portion connected to and extending rearwardly from the second shelf portion;

a ridge between a rearward edge of the second shelf portion and a forward edge of the horizontal third shelf portion;

a fourth shelf portion pivotally connected at its forward edge to a rearward edge of the third shelf portion;

a fifth shelf portion telescopically slidably mounted to the fourth shelf portion; and support means extending between the frame and at least one of the shelf portions for supporting the fourth and fifth shelf portions at a desired angular position with respect to the third shelf portion.

* * * * *